US007562505B2

(12) United States Patent
Tohanczyn, Jr.

(10) Patent No.: US 7,562,505 B2
(45) Date of Patent: Jul. 21, 2009

(54) SIDING PANEL ASSEMBLY WITH SLIDING JOINT

(76) Inventor: Edward W. Tohanczyn, Jr., 804 Huntingdon Ave., Glendora, NJ (US) 08029

( * ) Notice: Subject to any disclaimer, the term of this patent is extended or adjusted under 35 U.S.C. 154(b) by 193 days.

(21) Appl. No.: 11/256,297

(22) Filed: Oct. 21, 2005

(65) Prior Publication Data

US 2006/0101767 A1 May 18, 2006

Related U.S. Application Data

(60) Provisional application No. 60/620,823, filed on Oct. 21, 2004.

(51) Int. Cl.
*E04D 1/00* (2006.01)
*E04B 1/343* (2006.01)

(52) U.S. Cl. ..... 52/539; 52/579; 52/573.1; 52/542

(58) Field of Classification Search ..... 52/519, 52/520, 539, 573.1, 506.01, 592.1, 592.4, 52/544, 396.04, 396.1, 393, 542, 747.1
See application file for complete search history.

(56) References Cited

U.S. PATENT DOCUMENTS 403,844 A * 5/1889 Kanneberg ..... 52/520
2,332,812 A * 10/1943 Rieger et al. ..... 405/281
3,757,483 A * 9/1973 Torbett ..... 52/522
4,096,679 A * 6/1978 Naz ..... 52/551
5,074,093 A * 12/1991 Meadows ..... 52/537
5,150,555 A * 9/1992 Wood ..... 52/544
5,333,971 A * 8/1994 Lewis ..... 405/281
5,392,579 A * 2/1995 Champagne ..... 52/520
5,526,627 A * 6/1996 Beck ..... 52/519
5,675,955 A * 10/1997 Champagne ..... 52/521
5,839,247 A * 11/1998 Beck ..... 52/519
5,878,543 A * 3/1999 Mowery ..... 52/519
5,987,838 A * 11/1999 Beck ..... 52/519
6,050,041 A * 4/2000 Mowery et al. ..... 52/520
6,164,032 A * 12/2000 Beck ..... 52/519
6,226,950 B1 * 5/2001 Davis ..... 52/592.1
6,363,676 B1 * 4/2002 Martion, III ..... 52/519
6,370,832 B1 * 4/2002 McGarry et al. ..... 52/520
6,421,975 B2 * 7/2002 Bryant et al. ..... 52/528
6,715,250 B2 * 4/2004 Bryant et al. ..... 52/528
7,008,142 B2 * 3/2006 Moreau ..... 405/281
2002/0029537 A1 * 3/2002 Manning et al. ..... 52/518
2004/0003566 A1 * 1/2004 Sicuranza ..... 52/518

* cited by examiner

*Primary Examiner*—Robert J Canfield
*Assistant Examiner*—Brent W Herring
(74) *Attorney, Agent, or Firm*—Drinker Biddle & Reath LLP

(57) ABSTRACT

A siding panel assembly for covering an exterior building wall includes a first elongated component and a second elongated component. The first and second components are adapted to be connected at a joint. The joint allows the first and second components to slide laterally relative to one another.

16 Claims, 5 Drawing Sheets

SIDING PANEL ASSEMBLY WITH SLIDING JOINT

RELATED APPLICATION

This application is related to and claims priority from U.S. Provisional Application No. 60/620,823, filed Oct. 21, 2004, which is incorporated herein by reference in its entirety.

FIELD OF THE INVENTION

The present invention relates to the field building construction products generally, and, more particularly, to molded polymeric siding panels.

BACKGROUND OF THE INVENTION

Molded vinyl siding panels used to cover building exterior walls, particularly residential buildings, are well known in the prior art. Typically, 12 foot long elongated panels are attached in interlocking rows to the building exterior wall. Further typically, the panels are attached to the exterior wall using nails. Each individual siding panel is typically provided as a single-piece, unitary component having a body made to resemble two overlapping standard wooden exterior wall planks. An upper end of the siding panel is typically provided with a hem by which the panel is attached to the underlying wall. The hem may be of a single layer, or may be folded back upon itself to provide double layers. The hem is preferably provided with a plurality of apertures, each aperture sized and shaped to receive a nail. Typically, an outwardly projecting locking tab is provided adjacent to the hem, and connects the hem to the body. It is further known to provide an arcuately-shaped flange at a lower end of each panel. The flange is sized and shaped to interlock with the locking tab. Thus, the exterior wall may be covered by multiple rows of identical, interlocking siding panels, each panel being fixedly attached to the wall at the hem, and each panel also being connected by that panel's flange to a lower panel's locking tab and to an upper panel's flange by that panel's locking tab.

The connection between a first panel's locking tab and a second panel's flange is typically close fitting. Further, the flange is typically relatively flexible. In the prior art siding panels, the connection between a first panel's locking tab and a second panel's flange can be relatively easily disturbed, causing the two to separate. For example, the inventor of the present invention has determined that thermal effects, such as shrinkage in the underlying structure (such as floor joints) or lateral wind can cause separation. It is a common problem for the relatively close fitting conventional flange-locking tab connection to be unable to accommodate significant differential lateral (up and down) movement between joining panels, leading to the panels becoming disconnected. The resulting gap provides an entry path for rain and ice, increases the potential for damage to the building, and has a negative visual impact on the house. Repairs can be time-consuming and costly, since it typically involves removing 3 to 6 rows of panels above the separated panel. The panels are then loosely re-attached. The repair cost is typically in the range of $300 to $700.

The inventor has determined that separation of siding panels is particularly prevalent in two areas. The first area is along the floor joist area. This is due to shrinkage that occurs over the first few months to a couple of years in the underlying wood structure. The second area is where the siding panels meet an angled roof. The angular pitch of the roof tends to cause the ends of the panels tends to bend upward, causing buckling or warping of the panels. Currently,the only solution is to remove and replace siding panels when warpage or separation occurs.

A need exists, therefore, for a siding panel providing greater structural flexibility and reduced potential for separation of adjoining installed panels.

SUMMARY OF THE INVENTION

In a first aspect, the present invention relates to a two-component siding panel assembly comprising a first elongated component having a longitudinal axis in a first direction and a lateral axis in a second direction generally perpendicular to the first direction. A second elongated component has a longitudinal axis in a first direction and a lateral axis in a second direction generally perpendicular to the first direction. The first and second components are adapted to be connected at a joint. The joint allows the first and second components to freely slide relative to one another in a direction generally parallel to the first and second component lateral axes by an amount of at least 0.25 inches.

In a second aspect, the invention is a siding panel assembly comprising a first elongated component including a body having a first face and a second face and a first edge and a second edge. The body has a generally planar portion at least proximate the second edge. A locking tab connects to the body and is disposed proximate the first edge, extending from the first face. An attachment hem is connected to the locking tab and forms the first edge. A channel is connected to the body, disposed proximate the second edge, and extending from the second face. The channel has a width extending in a direction generally parallel to the body planar portion and also has a slot opening proximate the second end. The slot opening forms a gap having a thickness. A second elongated component is also provided, including a body having a first face and a second face and a first edge and a second edge. A locking lip is connected to the body and extends from the first face at the first edge. The locking lip has a thickness greater than the gap thickness. A flange is connected to the body and extends from the second face at the second edge. The channel is adapted to receive the locking lip, the body of the second component extending through the slot. The locking lip and the channel are sized and shaped to allow the first and second components to slide laterally relative to one another over a predetermined lateral distance while remaining connected. The siding panel assembly is adapted to be connected to an identical second siding panel assembly by connecting the flange to the locking tab of the second siding panel assembly, the flange being sized and shaped to releasably receive the locking tab of the second siding panel assembly.

The foregoing and other features of presently preferred embodiments of the invention and advantages of the presently preferred embodiments will become more apparent in light of the following detailed description, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a presently preferred embodiment of the invention. However, it should be understood that this invention is not limited to the precise arrangements and instrumentalities shown in the drawings.

DETAILED DESCRIPTION OF THE DRAWINGS

Figure 1:
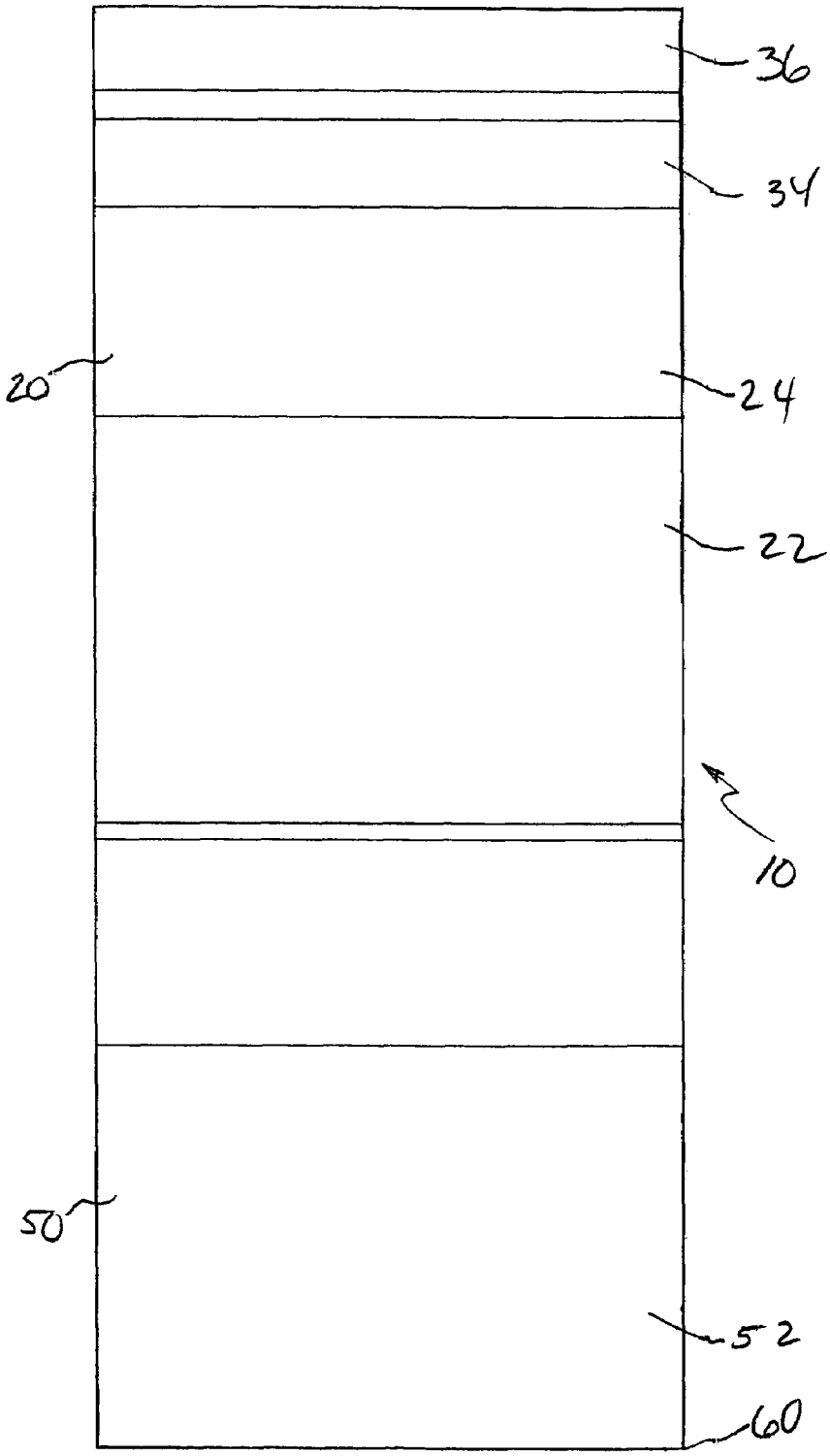
FIG. 1 is a front view of a siding panel assembly according to an exemplary embodiment of the invention.
Figure 2:
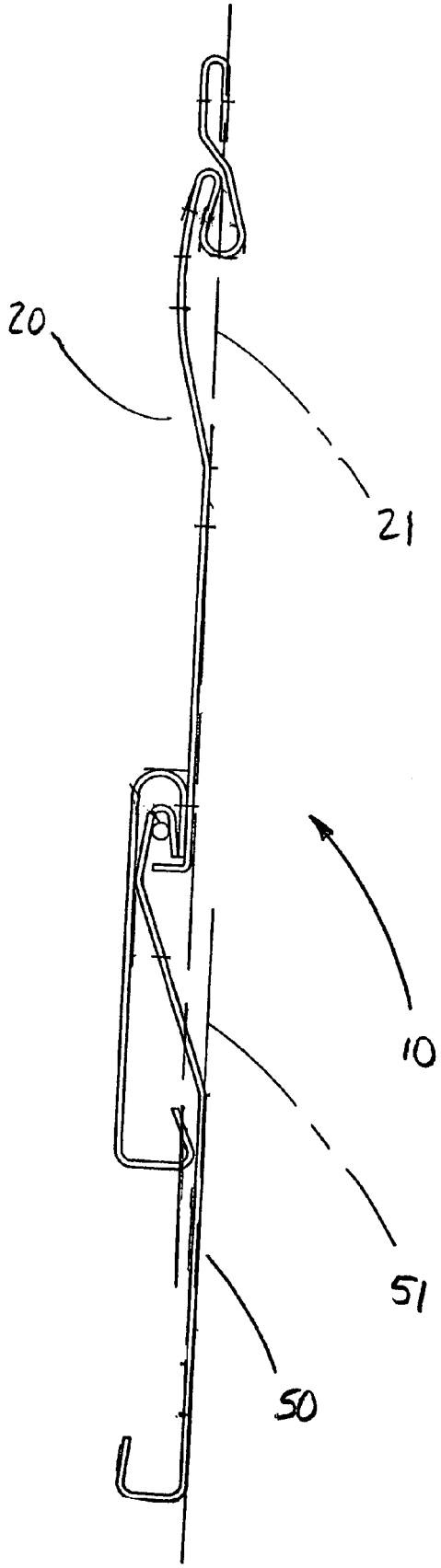
FIG. 2 is a side elevation view of the siding panel assembly of FIG. 1.

Referring now to the drawings, where like numerals identify like elements, there is shown in FIGS. 1 and 2 a siding panel assembly 10 according to an exemplary embodiment of the invention. The siding panel assembly 10 includes a first component 20 and a second component 50. A plurality of the siding panel assemblies 10 may be used to cover an exterior wall of a building (not shown).

Figure 3:
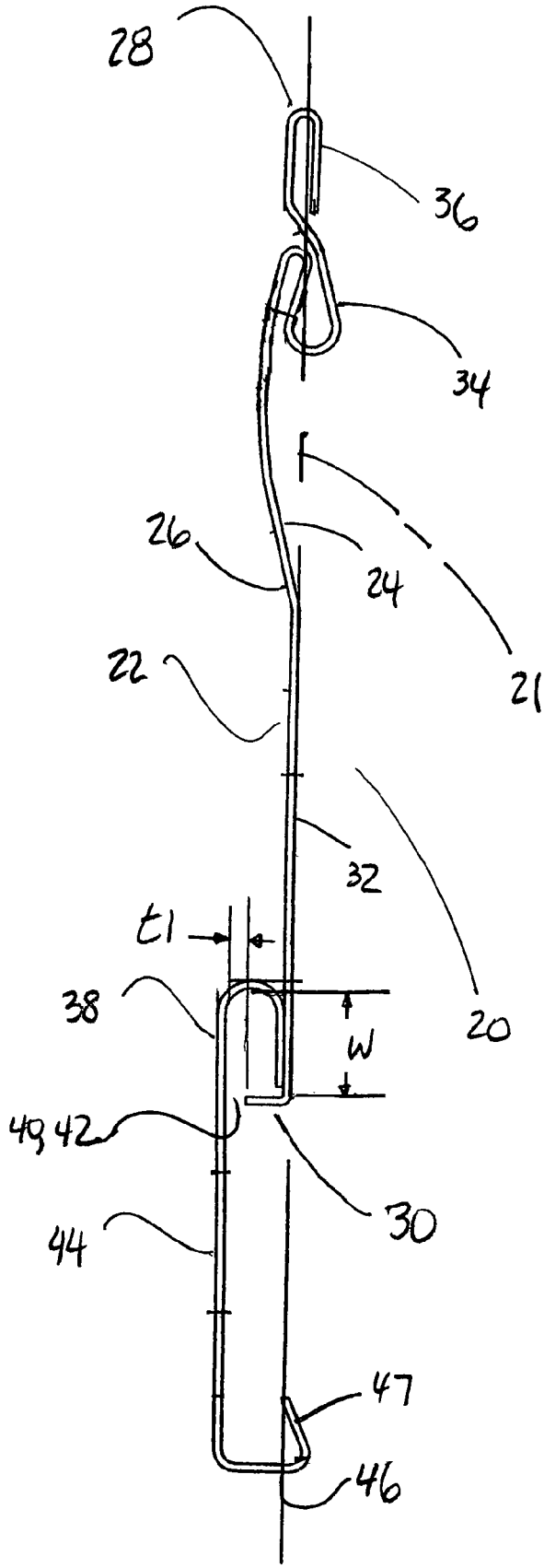
FIG. 3 is a side elevation view of a first component of the siding panel assembly of FIG. 1.

Referring to the front view of FIG. 1, the depicted siding panel assembly 10 is shown extending for a length that is limited to facilitate illustration of the assembly 10. It should be understood that the provided length of the siding panel assembly 10 could vary, preferably ranging from 4 to 12 feet. The first component 20, which is shown separately in FIG. 3, has a longitudinal axis along the length of the first component 20 and a lateral axis 21 across a width of the first component 20. The first component 20 includes a body 22 having a first face 24 and a second face 26 along with a first edge 28 and a second edge 30. The body 22 has a generally planar portion 32 at least proximate the second edge 30.

The first component 20 further includes a locking tab 34 connected to the body 22 and disposed proximate the first edge 28, extending from the first face 24. The locking tab 34 is preferably formed as a loop extending toward the second edge 30. As described further below, the locking tab 34 is sized and shaped to be releasably received within a flange 66 provided on the second component 50. While the locking tab is shown as a loop in the illustrated embodiment, it is contemplated that the tab can be formed in any shape that provides an engagement with a flange on the second component.

An attachment hem 36 is connected to the locking tab 34 and forms the first edge 28. In the embodiment illustrated, the attachment hem 36 is doubled over on itself, forming a 2 ply structure. Other arrangements, for example, a single layer attachment hem 36, are possible.

The first component 20 further includes a channel 38 connected to the body. The channel 38 is located near the second edge 30, and preferably extends from the second face 26. The channel is attached to the body 22 using any conventional fastening system, such as adhesive, ultrasonic welding, or co-injection molding. The channel 38 has a width W extending in a direction generally parallel to the body planar portion 32 and also has a slot opening 40 near the second end 30. The slot opening 40 forms a gap 42 having a thickness t1. Although the channel 38 is shown as a separate component attached to the body 22, it is also contemplated that the channel 38 could be formed integral with the body 22.

The first component may further include a generally planar support member 44 extending from a wall of the channel 38 in a direction away from the second end 30, and generally parallel to the body planar portion 32. A support member lip 46 may be provided at an end of the support member 44 opposite the end connected to the channel 38.

In one embodiment of the invention, the support member 44 is approximately 3 inches in length, the support lip has a length of about $9/16^{th}$ inch and a rim 47 of about $7/16^{th}$ inch. The channel 38 preferably has a length of about ½ inch to ¾ inch. The gap, t1, is preferably approximately $1/8^{th}$ inch.

Figure 4:
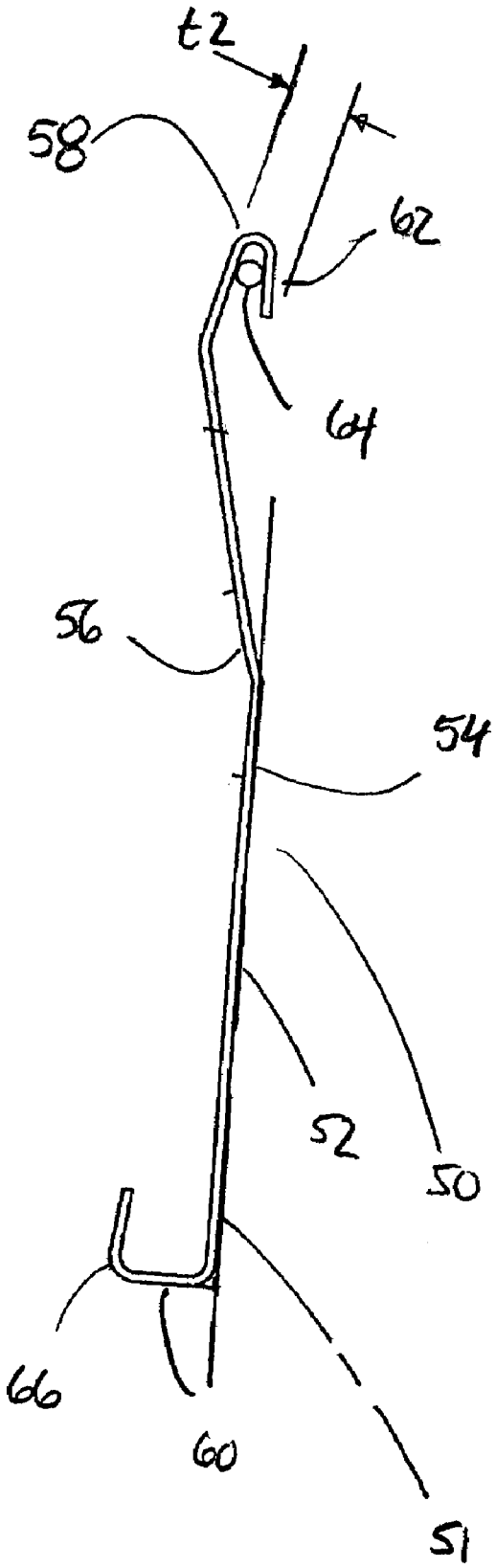
FIG. 4 is a side elevation view of a second component of the siding panel assembly of FIG. 1.
Figure 5:
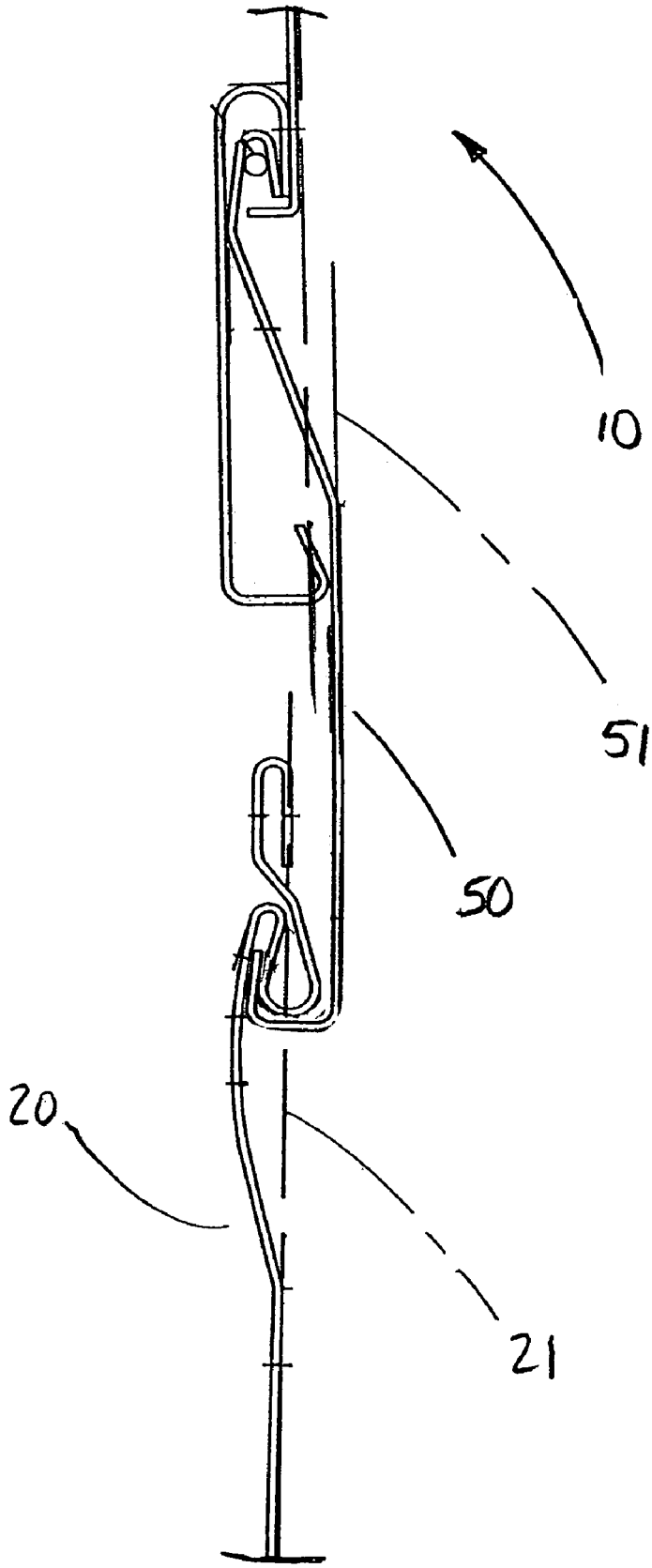
FIG. 5 is a partial side elevation showing a locking tab of a first siding panel assembly received by a flange of a second panel assembly.

With particular reference now to FIG. 4, the second component 50, like the first component 20, is also preferably provided in an elongated form, preferably in lengths ranging from 4 to 12 feet, although, again, other lengths are possible. The second component 50 has a longitudinal axis (not shown) along the length of the second component 50 and a lateral axis 51 across a width of the second component 50. The second component 50 includes a body 52 having a first face 54 and a second face 56 along with a first end 58 and a second end 60.

A locking lip 62 is connected to the second component body 52 and extends from the first face 54 at the first end 58. The locking lip 62 preferably includes a solid bead 64, about which a wall of the second component body 52 is folded to form the locking lip 62. In one embodiment, the bead is a plastic tubular strip with a $1/8^{th}$ inch diameter. However, a bead is not necessary. The locking lip 62 may, instead, be simply a bent over piece of the body 52, or the body may be formed with an enlarged (e.g., bulbous) end. The locking lip 62 has a thickness t2, which is preferably greater than the gap thickness t1, and thus, when the locking lip 62 is installed within the channel 38 (as shown in FIG. 2), the first and second components 20, 50 are prevented from easily becoming disconnected when pulled apart in a lateral direction by interference of the locking lip 62 with the channel slot 40.

The channel 38 is adapted to receive the locking lip 62, with the body of the second component 52 extending through the channel slot 40. The locking lip 62 and the channel 38 are sized and shaped to allow the first and second components 20, 50 to slide laterally relative to one another over a predetermined distance while remaining connected. The amount of movement is determined by the width W of the channel. Preferably, the predetermined distance is at least 0.25". However, depending on the application, the amount of movement that can be accommodated can be varied.

The second component body 52 includes a flange 66 at the second end 60 of the body. The flange 66 is preferably formed integral with the body and extends from the second face 56. As discussed above, the flange 66 is sized and shaped to releasably receive the locking tab 34. The flange 66 and locking tab 34 are preferably formed with a conventional shape so as to interconnect with conventional siding components.

Both the first and second components 20, 50 are preferably fabricated from conventional thermoplastic polymer material, such as polyolefins, polycarbonate, polyvinyl chloride or mixtures and copolymers thereof. Polyvinyl chloride (PVC) is particularly desirable in view of its relatively low cost, durability, and ability to be readily cut (facilitating the process of installing the siding panels 10). Preferably, the first and second components 20, 50 are fabricated using conventional fabrication techniques, such as injection molding. However, it is also contemplated that the siding assembly can be made from aluminum or any other metallic material, and be manufactured by cold rolling, extrusion, bending or other conventional molding process.

Also preferably, the first component body 22 is formed having a width and surface texture to resemble at least one standard wooden exterior wall plank and the second component body 52 is also formed having a width and surface texture to resemble at least one standard wooden exterior wall plank. In the illustrated embodiment, the first and second bodies 22, 52 are preferably formed to each resemble half of a standard 10 inch double Dutch lap. Other styles of finishes could also be used.

In use, the first component 20 (with or without the second component 50 attached, as described below) is attached in a desired location to the exterior wall (not shown) at the attachment hem 36 using conventional fasteners such as nails. Preferably, the first edge 28 and attachment hem 36 are positioned on the exterior wall above the second edge 30. Alternatively, the attachment hem 36 could be positioned below the second edge 30 on the exterior wall.

Either before or after the first component 20 is fixed to the exterior wall, the siding panel assembly 10 is assembled by sliding the locking lip 62 into the channel 38 from the side, in a longitudinal direction.

Once a first siding panel assembly 10 is installed on the exterior wall, an identical second siding panel assembly 10 is then installed on the exterior wall in a manner similar to installation of the first siding panel assembly 10, with an additional step that the flange 66 of the second siding panel assembly 10 is connected to the locking tab 34 of the first siding panel assembly 10. As noted above, the flange 66 is sized and shaped to releasably receive the locking tab 34 of an adjacent siding panel assembly 10. In a like manner, additional interconnecting rows of siding panels 10 are added until the exterior wall is fully covered.

A siding panel assembly is thus disclosed including a first elongated component and a second elongated component, the first and second components adapted to be connected at a sliding joint. The joint allows the first and second components to slide laterally relative to one another over a predetermined distance. The siding panel assembly thus provides improved structural flexibility and reduced potential for separation of adjoining installed panels due to temperature-induced or wind-induced differential movement between adjoining siding panels.

The siding panel assembly of the present invention is primarily intended to provide vertical adjustment, i.e., the panels are mounted horizontally (as with conventional siding) such that the channel permits vertical sliding of lip within the channel. It should be readily apparent that while the preferred orientation of the siding assembly would be such that there is vertical adjustment, any other orientation is possible.

It is contemplated that the present invention will be used in selective areas of building construction and, in particular, along areas where shrinkage in the underlying structure is likely to occur. As such, in order to identify the siding panel of the present invention from conventional panels, a removable or degradable indicator (such as a colored line) may be formed on one side of the panel.

The present invention may be embodied in other specific forms without departing from the spirit or essential attributes thereof.

What is claimed is:

1. A siding panel assembly for use in external siding of a building structure, comprising:

a first panel component including a body having a front face a portion of which defines an exposed face of the siding panel assembly, and a rear face, the first panel component having a longitudinal axis extending along a length of the first panel component and a lateral axis substantially perpendicular to the longitudinal axis; and a second panel component including a body having a front face a portion of which defines an exposed face of the siding panel assembly, and a rear face, the second panel component having a longitudinal axis extending along a length of the second panel component and a lateral axis substantially perpendicular to the longitudinal axis, the second panel component being separate from and slidably engageable with the first panel component to form the panel assembly, the first panel component including a channel having a width extending along the lateral axis, the channel being located on the rear face of the first panel, the channel having an interior cavity and a slot opening formed on the bottom of the channel, the slot opening having a thickness dimension and permitting access to the interior of the channel from the bottom of the first panel, the second panel component having a locking lip formed at an end of the body and adapted for receipt within the cavity of the channel of the first panel component, the locking lip having a thickness that is greater than the thickness of the slot opening such that the first and second panel components may be connected to each other by sliding the locking lip into the channel cavity in a direction substantially parallel to the longitudinal axis of the first panel component with a portion of the body of the second panel component extending through the slot opening, the locking lip having a width in the lateral direction that is less than the width of the channel so as to define a sliding gap, the gap permitting the locking lip of the second panel component to slide freely within the channel of the first panel component in a direction substantially parallel to the lateral axis of the first panel component while the first and second panel components remain connected to each other;

the assembly permitting relative lateral movement between the first and second panel components for accommodating changes in the building structure;

wherein the channel includes a rear leg that extends downward past the slot opening and the bottom of the body of the first panel component to define a planar support member, and wherein a support member lip is formed on a lower end of the planar support member and projects forwardly, the support member lip adapted to contact the rear face of the second panel component for providing support for a portion of the second panel component at a location spaced apart from the connection between the locking lip and the channel.

2. The siding panel assembly according to claim 1, wherein the locking lip of the second panel component is free to slide within the channel of the first panel component over a distance that is at least 0.25 inches.

3. The siding panel assembly according to claim 1, wherein the first panel component includes a locking tab and the second panel component includes a flange adapted to receive the locking tab to provide for attachment of the first panel component of one siding panel assembly to the second panel component of an adjacent panel assembly.

4. The siding panel assembly according to claim 3, wherein the first panel component includes an attachment hem adjacent the locking tab.

5. The siding panel assembly according to claim 3, wherein the locking tab of the first panel component includes a looped portion.

6. The siding panel assembly according to claim 1, wherein body of the second panel component includes an angled wall and wherein the locking lip includes a bead formed by the wall being folded over itself.

7. The siding panel assembly according to claim 1, wherein the first and second panel components are oriented such that the locking lip slides in the channel so as to provide substantially vertical adjustment of the first panel component relative to the second siding component.

8. A siding panel assembly comprising:

a first siding panel component having a length extending along a longitudinal axis of the first siding panel component, the first siding panel component having a lateral axis substantially perpendicular to the longitudinal axis, the first siding panel component including a body, a locking tab, an attachment edge and a channel, the body having a first face a portion of which forms an exposed face of the panel assembly, and an opposite second face on the rear side of the body from the first face, and the body including a substantially planar portion, the attachment edge located along at least a portion of an upper edge of the first siding panel component, the locking tab located between the attachment edge and the body, and the channel located adjacent a lower edge of the body and extending rearward from the second face, the channel having a width extending substantially along the lateral axis, the channel having an interior and a slot opening communicating with the interior, the slot opening located on the bottom of the channel; and a second siding panel component having a length extending along a longitudinal axis of the second siding panel component, the second siding component having a lateral axis substantially perpendicular to the longitudinal axis, the second siding panel component including a body having a first face a portion of which forms an exposed face of the panel assembly, and an opposite second face on the rear of the body, a locking lip, and a flange, the locking lip located along at least a portion of an upper edge of the second siding panel component, the locking lip having a thickness that is greater than a thickness defined by the slot opening in the channel such that the first and second siding panel components are connected to each other by insertion of the locking lip into the interior of the channel in a direction substantially parallel to the longitudinal axis of the first siding panel component with a portion of the body of the second panel component extending through the slot opening, the flange connected to the body and defining a second edge of the second siding panel component, the locking lip and channel dimensioned to define a slide gap between the locking lip and the channel in the lateral direction such that the first and second siding panel components are free to slide with respect to each other along the lateral axis over a predetermined distance while remaining connected, the locking tab and flange adapted to provide for releasable attachment of the locking tab of a first siding panel assembly to the flange of a second siding panel assembly.

9. The siding panel assembly according to claim 8, wherein the body of each of the first and second siding panels components is dimensioned and textured to resemble at least one standard wooden exterior wall plank.

10. The siding panel assembly according to claim 8, wherein each of the first and second siding panel components comprises a thermoplastic polymer material selected from the group consisting of polyolefins, polycarbonate, polyvinyl chloride, and mixtures and copolymers thereof.

11. The siding panel assembly according to claim 10, wherein the first and second siding panel components are fabricated by injection molding.

12. The siding panel assembly according to claim 8, wherein the first siding panel component includes a generally planar support member extending from a wall of the channel, the support member substantially parallel to the planar portion of the body.

13. The siding panel assembly according to claim 12, wherein the support member includes a lip.

14. The siding panel assembly according to claim 8, wherein locking lip includes a wall and a bead, the wall of the locking lip folded about the bead.

15. The siding panel assembly according to claim 8, wherein the first and second siding panel components are oriented such that the locking lip slides in the channel so as to provide substantially vertical adjustment of the first siding panel component relative to the second siding panel component.

16. The siding panel assembly according to claim 8, wherein the channel includes a rear leg that extends downward past the slot opening and the bottom of the body of the first siding panel component to define a planar support member, and wherein a support member lip is formed on a lower end of the planar support member and projects forwardly, the support member lip adapted to contact the second face of the second siding panel component for providing support for a portion of the second siding panel component at a location spaced apart from the connection between the locking lip and the channel.

* * * * *